United States Patent [19]

Nederveld

[11] Patent Number: 4,777,994

[45] Date of Patent: Oct. 18, 1988

[54] SUNSHIELDING DEVICE FOR A MOTOR VEHICLE

[75] Inventor: Terrill L. Nederveld, Ada, Mich.

[73] Assignee: Packaging Corporation of America, Evanston, Ill.

[21] Appl. No.: 71,706

[22] Filed: Jul. 9, 1987

[51] Int. Cl.[4] ..... A47H 5/00

[52] U.S. Cl. ..... 160/84.1; 160/370.2; 296/97.7; 296/97.8; 493/405

[58] Field of Search ..... 160/368 S, 84 R, DIG. 2; 296/97 R, 97 E, 97 G, 95 R, 95 Q, 95 C; 493/405

[56] References Cited

U.S. PATENT DOCUMENTS

| | | | |
|---|---|---|---|
| 4,652,039 | 3/1987 | Richards | 160/DIG. 2 X |
| 4,671,334 | 6/1987 | Yadegar et al. | 160/84 R |
| 4,727,920 | 3/1988 | Siegler | 160/DIG. 3 |

*Primary Examiner*—Ramon S. Britts
*Assistant Examiner*—Blair M. Johnson
*Attorney, Agent, or Firm*—Neuman, Williams, Anderson & Olson

[57] ABSTRACT

A sunshielding device is provided which is formed from a blank of lightweight, foldable, opaque relatively stiff sheet material. The device includes a plurality of multilateral panels arranged in side by side relation and adjacent panels being interconnected by non-parallel foldlines. The device is manually adjustable between operative and inoperative modes. When in an operative mode, the panels are unfolded relative to one another so as to overlie the interior surface of a motor vehicle windshield when the device is positioned proximate the interior surface. The non-parallel foldlines and the resulting panels allow the device, when in its operative mode, to readily conform to the curvature of the windshield interior surface. The unfolded device is held against the interior surface by one or both of the sunvisors provided adjacent the upper periphery of the windshield. When the device is in an inoperative mode, the panels assume a face to face relation forming a flat compact unit suitable for storage.

5 Claims, 4 Drawing Sheets

FIG. 3
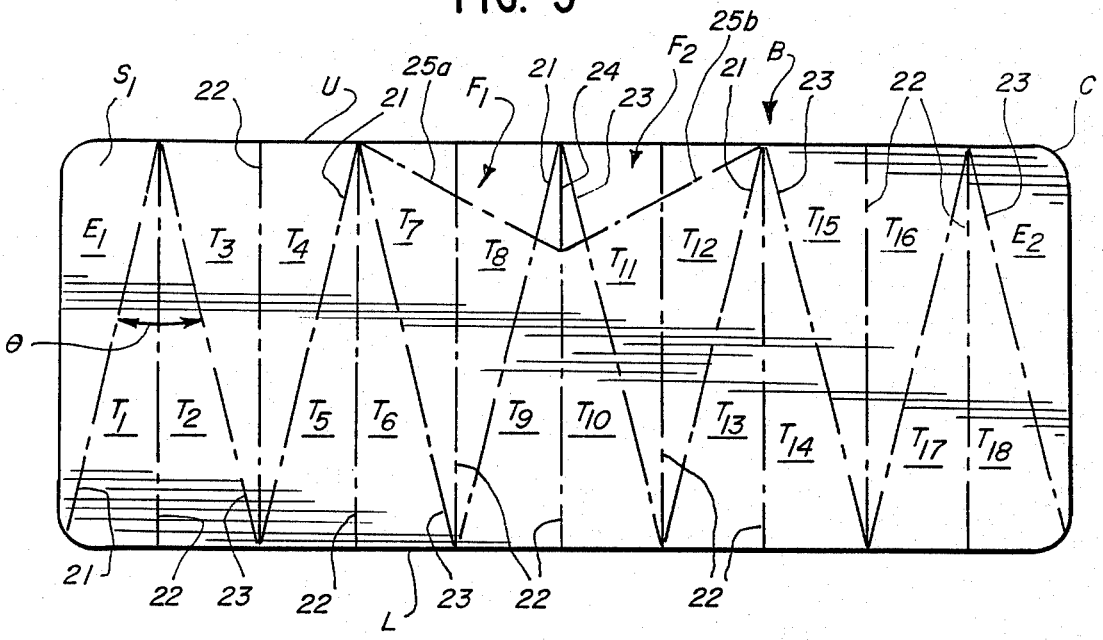
FIG. 4
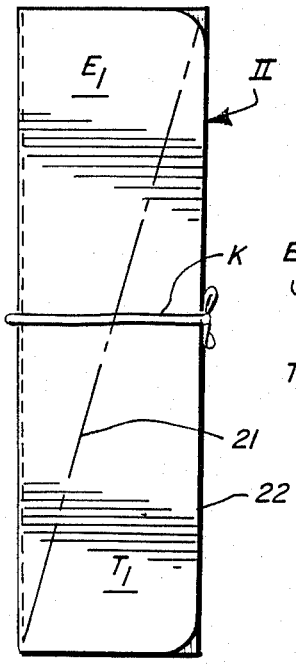
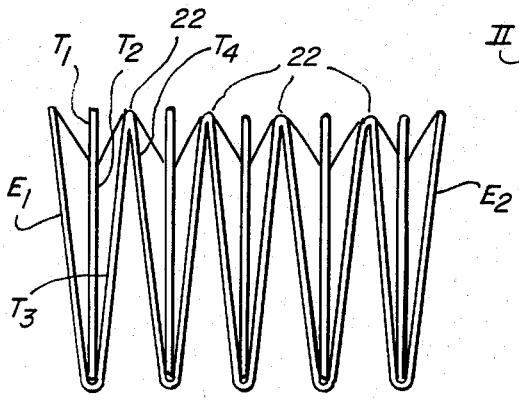
FIG. 6
FIG. 5
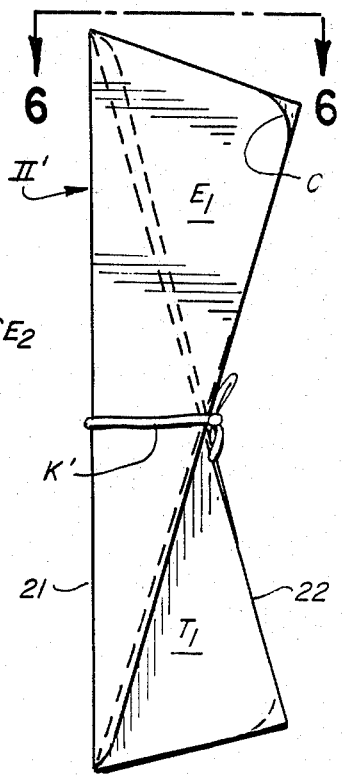

FIG. 7
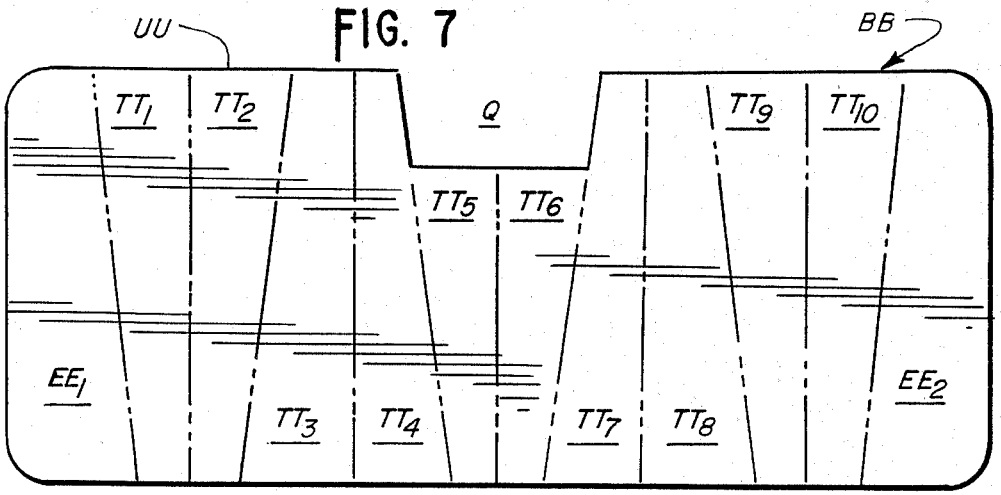
FIG. 8
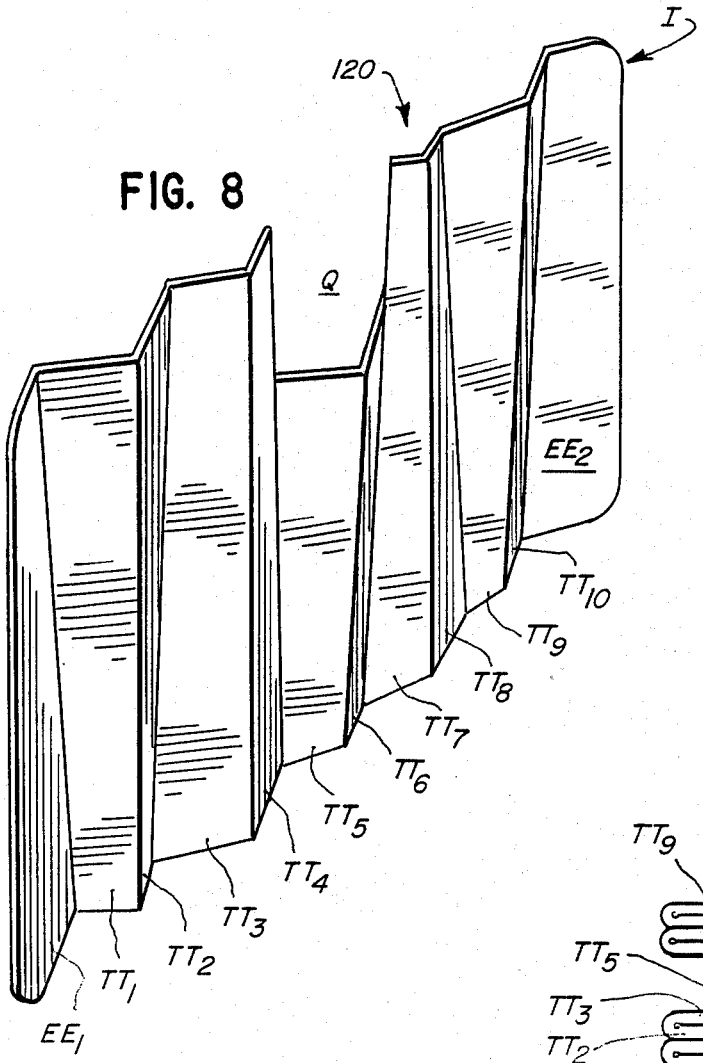
FIG. 9
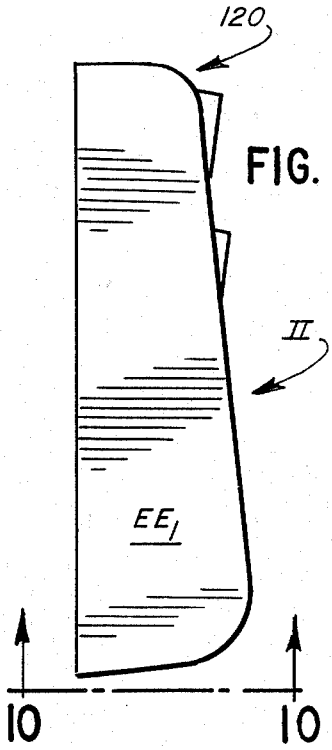
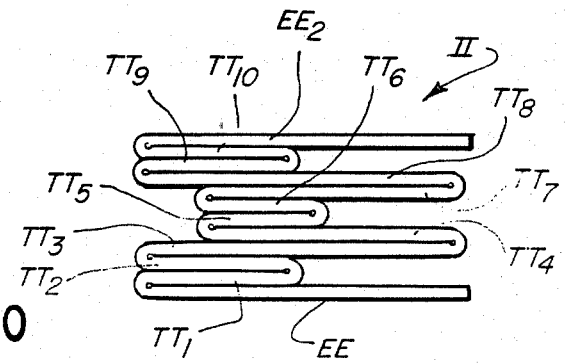
FIG. 10

FIG. 11
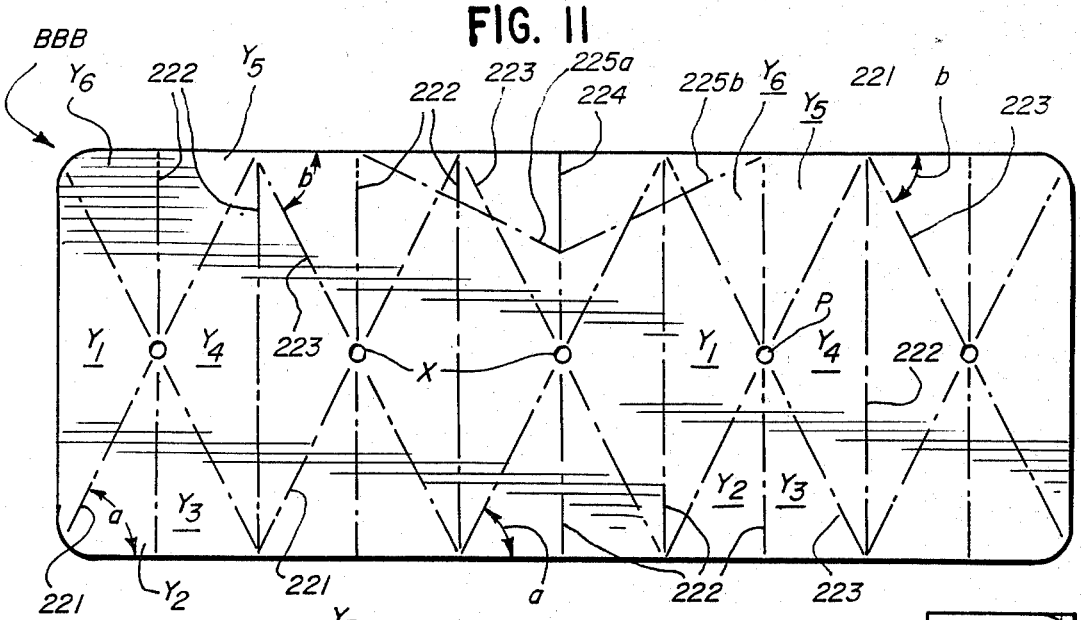
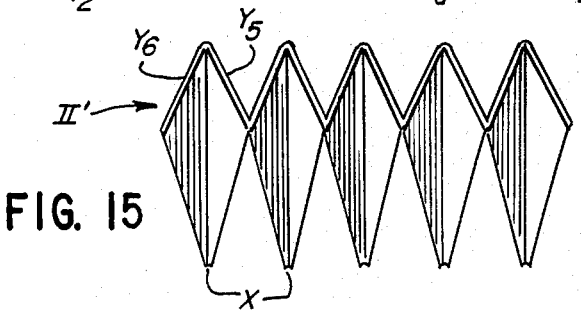
FIG. 15
FIG. 13
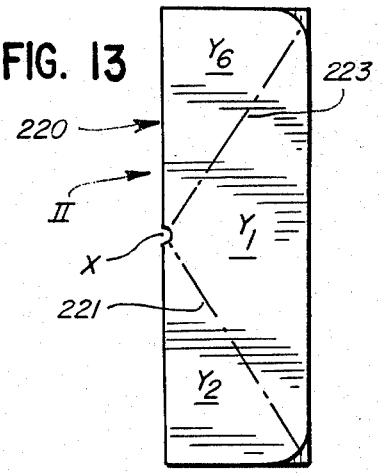
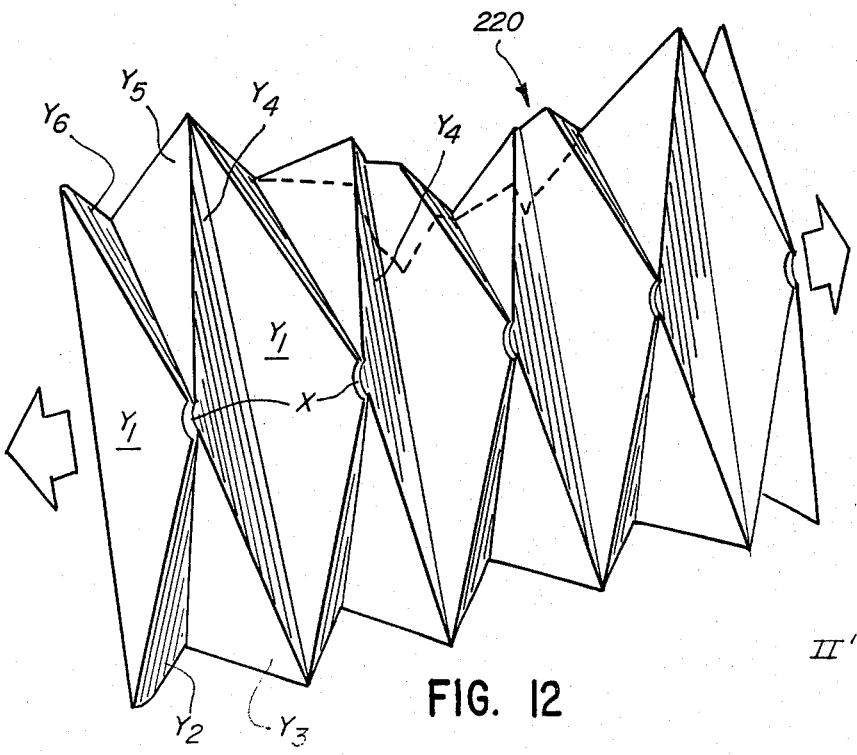
FIG. 12
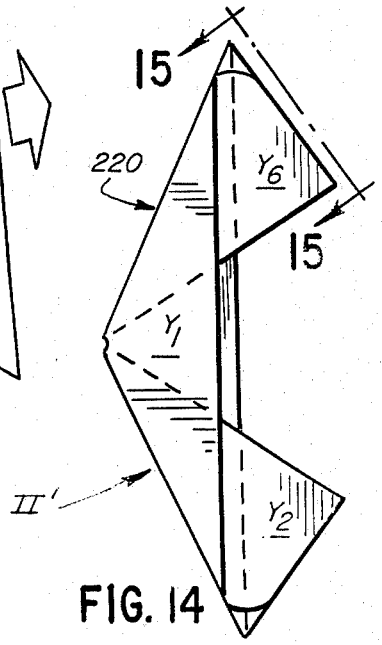
FIG. 14

SUNSHIELDING DEVICE FOR A MOTOR VEHICLE

FIELD OF THE INVENTION

The invention relates to a foldable sunshielding device which is adapted to be located proximate the interior surface of a windshield of a parked vehicle so as to deflect and block the sun's rays from the interior of the vehicle.

BACKGROUND OF THE INVENTION

In various geographical areas and particularly during certain seasons of the year, the sun's rays are frequent and intense with the result that the interior of a parked vehicle exposed for even a short period of time to the sun's rays can become extremely hot and uncomfortable, particularly where for security reasons the doors of the vehicle are locked closed and the windows are shut tight. Where the steering wheel, steering column, gear shift lever, and various knobs and switches located on the dashboard are exposed to such sun's rays they can become blistering hot causing pain and discomfort when touched by the driver or passenger. Furthermore, where the vehicle seats are upholstered in leather or plastic material, they can also become uncomfortably warm when exposed to the sun's rays, causing heat to radiate therefrom. To avoid exposure to the sun's rays, a driver will normally seek a shady location in which to park the vehicle. Oftentimes such a location is not readily available, and even if found, the shade will last only a short period of time because of a change in the direction of the sun and thus, such a location does not effectively solve the aforementioned heat problems. Where the shady location is under a tree, the exterior of the parked vehicle is exposed to sap or various debris falling from the tree causing spotting, soiling or defacement of the vehicle exterior.

Various devices for deflecting and/or blocking the sun's rays have heretofore been utilized such as roller shades, blinds, curtains, visors and the like. Such devices, however, are beset with one or more of the following shortcomings: (a) the device is of costly, complex and/or bulky construction; (b) the device is permanently installed and the installation thereof is difficult, awkward and time-consuming; and (c) the device oftentimes detracts from the esthetic appearance of the vehicle.

Recently, portable inexpensive devices such as disclosed in U.S. Pat. No. 4,202,396 issued to Abraham Levy, have been utilized in an attempt to resolve the aforementioned sun-ray problem. The Levy device incorporates a plurality of foldably interconnected rectangular panels arranged in side-by-side relation. In certain embodiments of the Levy device, tabs, flaps and eyelets are utilized in order to properly position the device in a desired location. Because of the rectangular configuration of the panels, the device is not capable in certain instances of conforming to a wide variety of windshield interior surface configurations. Furthermore, the planar surfaces of adjacent rectangular panels tend to deflect the sun's ray in generally the same direction thereby reducing the effectiveness of the device as a sunshield.

Another recent sunshielding device which is commercially available utilizes a pair of fan-shaped units mounted for pivotal adjustment on the interior of the windshield adjacent a lower perimetric segment thereof. One unit is aligned in front of the driver's seat and the other unit is aligned with the passenger's front seat. Each unit includes a plurality of elongated slats or blade-like members which are pivotally connected to one another at a corresponding one end. The opposite ends of the slats are interconnected by one or more flexible tapes or cords. When the unit is functioning as a sunshield, the slats are pivoted relative to one another in a fan-like arrangement so as to cover a substantial portion of the windshield interior surface. When the unit is not in use, the slats are pivoted into a registered face-to-face relation and rest along the lower perimetric segment of the windshield. The fan-like device is secured to the windshield interior surface by suction cups or the like. While effectie to a certain extent as a sunshield, the fan-like device is beset with many of the aforementioned shortcomings associated with prior devices. Furthermore, because only one end of each slat is pivotal connected, the slats, when disposed in an inoperative mode, that is, when they are disposed in registered face-to-face relation, the vibration created when the vehicle is moving would likely cause the slats to produce an undesirable rattle.

Accordingly, it is an object of the present invention to provide an improved sunshielding device which avoids the aforementioned disadvantages and shortcomings of the prior art.

It is another object of the present invention to provide an improved, foldable sunshielding device which is effective as a sunblock and which is highly versatile for use in conjunction with a variety of shapes, contours and sizes of vehicular windows.

It is a further object to provide an improved, foldable sunshielding device with the capability to operate without the use of several secondary support means.

It is a further object to provide an improved, foldable sunshielding device which is of simple inexpensive construction and is capable of being collapsed into a compact readily storable unit when not in use.

Other objects of the present invention will become apparent from the specification, appended claims and accompanying drawings.

In accordance with one embodiment of the invention a portable sunshielding device is provided which is formed from a blank of foldable, relatively stiff, lightweight inexpensive, opaque sheet material. The blank is provided with a plurality of non-parallel foldlines extending between the upper and lower edges of the blank. The foldlines define a plurality of multilateral panels which coact with one another, when the device is in an operative mode, to substantially cover the interior surface of the windshield of a parked vehicle. When in the operative mode, the device is positioned so that the lower edges of the panels are adjacent a lower perimetric segment of the windshield and are supported by an upper surface of the vehicle dashboard. The upper edges of the panels are positioned in close proximity to an upper perimetric segment of the windshield. The upper edge portions of certain of the panels engage hand-manipulated interior sun-visors, which are of conventional design and commonly located proximate the upper portion of the windshield. Because the foldlines are disposed in a nonparallel relation, the panels are adapted to be compatible with a wide variety of windshield shapes. When the device is in an inoperative mode, the panels assume a stacked face-to-face relation forming a substantially flat compact unit suitable for storage.

DESCRIPTION

For a more complete understanding of the invention reference is made to the drawings wherein:

FIG. 3 is a plan view of the blank for the sunshielding device shown in FIG. 1.

FIGS. 4 and 5 are similar plane views of the device of FIG. 1 showing the panels thereof in two different arrangements, when the device is in an inoperative, or collapsed, mode.

FIG. 6 is a view of the device taken along line 6—6 of FIG. 5.

FIG. 7 is similar to FIG. 3 but of a blank for a second embodiment of the improved sunshielding device.

FIG. 8 is a fragmentary perspective front view of the second device per se formed from the blank of FIG. 7 and shown in an operative mode.

FIG. 9 is similar to FIG. 4, but of the device of FIG. 8.

FIG 10 is a top view of the device of FIG. 9.

FIG. 11 is similar to FIG. 3 but of a blank for a third embodiment of the improved sunshielding device.

FIG. 12 is similar to FIG. 8 but of the device formed from the blank of FIG. 11.

FIGS. 13, 14, and 15 are similar to FIGS. 4 and 5 respectively, but of the device of FIG. 12.

FIG. 15 is an enlarged end view taken along line 15—15 of FIG. 14.

Figure 1:
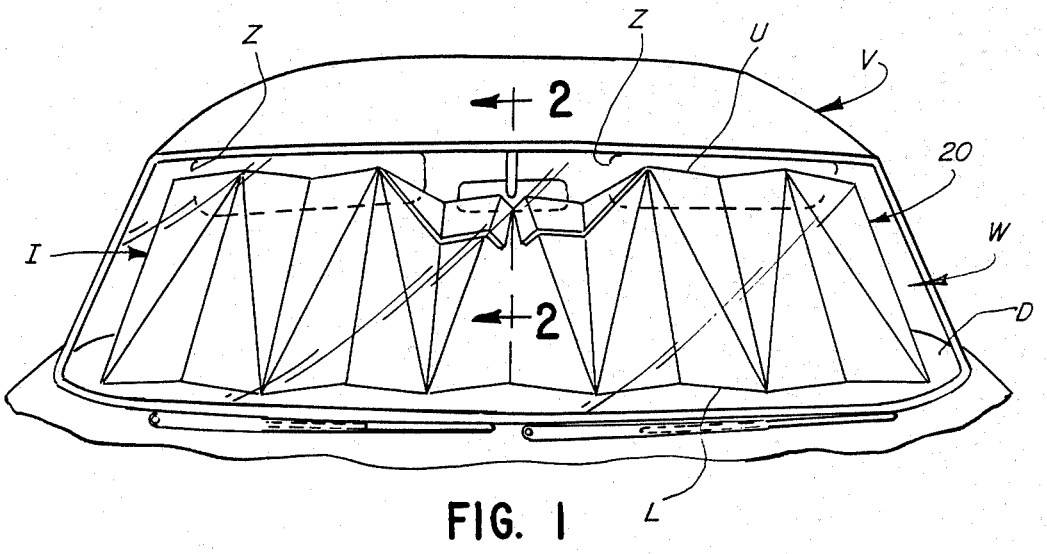
FIG. 1 is a fragmentary perspective front view of the exterior a vehicle windshield showing one embodiment of the improved sunshielding device in an operative mode and disposed proximate the windshield interior surface.
Figure 2:
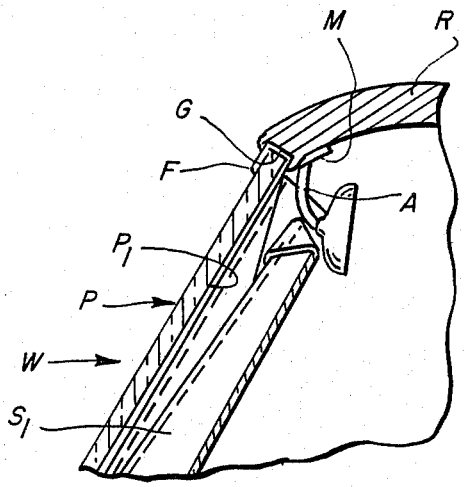
FIG. 2 is a fragmentary sectional view taken along line 2—2 of FIG. 1.

Referring now to the drawings and more particularly to FIGS. 1 and 2, a preferred embodiment 20 of the improved sunshielding device is shown set up in an operative mode I and positioned proximate the interior surface of a windshield W of a conventional passenger vehicle V. The windshield W may be of various sizes and shapes and will depend upon the esthetics and aerodynamics of the vehicle body design in which it is installed.

Basically, the windshield W includes a pane P of clear, or tinted, shatter-proof glass having the periphery thereof engaged and encompassed by a frame F of suitable weatherstripping material or a trim strip of metal or plastic material, see FIG. 2. The windshield W is fitted into a suitable pocket or groove G, portions of which are formed in the roof R and side posts of the vehicle. The lower peripheral segment of the windshield is secured to the hood section of the vehicle by a suitable bracket or the like. The construction of the windshield and the method by which it is secured to the vehicle body form no part of the improved sunshielding device 20 to be heeeinafter described.

Device 20 is formed from a substantially rectangular blank 21 of foldable opaque sheet material (e.g., double-faced corrugated fibreboard). It is preferred that the surface $S_1$ of the blank B, which wil be disposed adjacent the interior surface $P_1$ of the glass panel P, and exposed to the sun's rays when the device is in the operative mode be bleached or whitened so as to more effectively reflect the sun's rays. If desired, the surface $S_1$ may have appealing graphics or other indicia imprinted thereon. The corners C of the blank B may be rounded, if desired, to facilitate handling when the device is being positioned adjacent the windshield interior surface, as will be described more fully hereinafter.

The blank B is provided with sets of foldlines 21, 22 and 23 which, extend between the upper and lower peripheral edges U and L of the blank. Foldlines 22, constituting one set as noted in FIG. 3 are arranged in laterally spaced substantially parallel relation and are disposed substantially perpendicular to the upper and lower peripheral edges of the blank. Foldlines 21 and 23, on the other hand, are angularly disposed relative to the blank upper and lower edges. The foldlines 21, 22 and 23 coact with one another to form foldably connected, adjoining triangular panels $T_1$–$T_{18}$. It will be noted in FIG. 3, that each foldline 22 bisects an included angle $\theta$ formed by adjacent foldlines 21 and 23 intersecting one another at either the upper or lower edge U or L of the blank B. Except for the endmost foldlines disposed at opposite ends of the blank, each foldline 21 or 23 extends diagonally between adjacent foldlines 22 and interconnects opposite ends thereof. As a result of the foldline arrangement, each area between adjacent foldlines 22 is formed into a pair of adjoining inverted right angle triangular panels; such as for example $T_2$–$T_3$. In the illustrated embodiment of blank B, the spacing between adjacent foldlines 22 is uniform with the result that all of the triangular panels $T_1$–$T_{18}$ are of like configuration. If desired, the end panels $E_1$, $E_2$ may have the same, or substantially the same, configuration as the intermediate triangular panels $T_1$–$T_8$. Furthermore, the spacing between adjacent foldlines 22 may be non-uniform if desired.

As noted in FIG. 3, the foldline 22 disposed at the center of blank B has the upper end thereof terminating at the lower end of a relatively short slot 24. The upper end of slot 24 terminates at the blank upper edge U.

Extending angularly upwardly and outwardly in opposite directions from the lower closed end of slot 24 is a pair of divergent foldlines **25*a*, 25*b*, the upper ends of which terminate at the blank upper edge U. The slot 24 and foldlines 25*a*, 25*b* coact to form lateral triangular flaps $F_1$, $F_2$ which may be folded so that an arm A of a rear view mirror mounting bracket M will not interfere with the proper positioning of the device 20 adjacent the interior surface of the vehicle windshield W, see FIGS. 1 and 2**.

When device 20 is in its operative mode I as seen in FIG. 1, the foldlines 21–23 of blank B allow the latter to assume an unfolded position wherein it substantially conforms to the curvature of the interior surface $P_1$ of the glass pane P and covers substantially the entire area of the panel which is exposed to the sun's rays. Besides allowing the device 20 to compensate for the interior surface curvature, the foldlines 21–23 cause the triangular panels $T_1$–$T_{18}$ and end panels $E_1$ and $E_2$ to assume various angular positions with respect to the pane P and thus, the sun rays reflected by the panels will be diffused throughout the pane and not be further reflected off the pane interior surface in directions toward either the driver or passenger. The angular dispositions of the triangular panels $T_1$–$T_{18}$ create numerous upright corners which provide added stiffness to the device 20 when in the operative mode, and also broadens the area of the vehicle dashboard D supportingly engaging the lower edge L of the device and thus, provides greater stability for the device.

When the device 20 is properly installed with respect to windshield W, the portion of the device adjacent the upper edge U thereof is engaged by one or both of the downwardly pivoted sun-visors Z normally provided within the vehicle interior, as seen more clearly in FIG. 1.

When device 20 is not in use, it may be collapsed so as to assume a substantially flat compact unit II,II' which is suitable for storage or the like, see FIGS. 4 and 5, respectively. In unit II, the triangular panels disposed between adjacent foldlines 22 assume a substantially coplanar relation, and then each pair of coplanar triangular panels are folded together about adjacent foldlines 22 until the coplanar triangular panels are disposed in stacked substantially superposed relation, see FIG. 4, and retained in such relation by suitable clips, tapes, cords, rubber bands or the like K. Unit II, when viewed from either the front or back, as seen in FIG. 4 has a substantially rectangular silhouette.

In unit II' the adjacent triangular panels are folded relative to one another about the adjacent foldlines 21–22 and 22–23 so that they assume a substantially face-to-face relation, see FIGS. 5 and 6. The triangular and end panels of unit II' are retained in a collapsed relation by a suitable cord K' or the like.

Either unit II, II' is substantially flat, of a compact size and may be conveniently stored within the vehicle interior or the vehicle trunk. Because the device 20, as well as the others to be hereinafter described, are formed of light-weight, yet sturdy corrugated medium, it may be readily manipulated by young and old alike.

A second version of the improved sunshielding device 120 is shown in FIGS. 7–10. The principal differences between devices 20 and 120 are (a) the adjoining panels $TT_1$–$TT_{10}$ of device 120 have a trapezoidal configuration instead of triangular as in device 20; (b) a substantially rectangular cutout Q is formed along the upper edge UU of the blank BB at approximately midlength, see FIG. 7; and (c) each of the trapezoidal panels provides a larger area on which graphics or indicia can be imprinted. As seen in FIG. 8, when device 120 assumes its unfolded operative mode I, the device will readily adapt to the curvature of the interior surface $P_1$ of the windshield pane P and the various panels thereof will assume various angular relative positions.

The end panels $EE_1$ and $EE_2$ are also of trapezoidal configuration and substantially conceal therebetween the intermediate panels $TT_1$–$TT_{10}$, when the device 120 is in its collapsed inoperative mode II, see FIGS. 9–10.

Cutout Q is sized so as to allow the device 120 to be readily positioned adjacent the windshield interior surface $P_1$ without interference from the rearview mirror R or its mounting bracket M and arm A.

FIGS. 11–15 illustrate a third version of the improved sunshielding device 220. The principal difference between device 220 and the previously described devices 20, 120 is in the arrangement of the foldlines in the blank BBB from which device 220 is formed. A plurality of foldlines 222 are provided which are arranged in spaced, substantially parallel relation and are disposed substantially perpendicular to the top and bottom edges of the blank. Second foldlines 221 are in spaced, substantially parallel relation but extend upwardly at an angle a relative to the lower edge of the blank BBB. As noted in FIG. 11, starting from the left end of the blank, a first foldline 221 extends from the lower left corner of the blank at angle a, intersects the first perpendicular foldline 222 at substantially its midlength, and then terminates at the intersection of the blank upper edge and the upper end of the foldline 222 which is disposed second from the left end of the blank. The second foldline 222 has the lower end thereof connected to the upper end of the foldline 222, which is fourth from the left end of the blank by the foldline 221 which is second from the left end of the blank. Each successive foldline 221 follows the same pattern; namely, connecting the lower end of one foldline 222 with the upper end of the next alternate foldline 222 and intersecting the intermediate foldline 222 at substantially its midlength.

Third foldlines 223 are provided in blank BBB which are disposed in spaced substantially parallel relation and extend downwardly from the upper edge of the blank at an angle b, see FIG. 11. Angles a and b are preferably the same so that corresponding foldlines 221 and 223 will intersect the same foldline 222 at a common point X. In the illustrated device 220, the common point X is defined by a small circular opening.

As in the case of device 20, the center foldline 222 has the upper end thereof terminating in an aligned slot 224. If desired, however, a cutout Q may be substituted for the slot 24 or 224 of device 20 or 220. A pair of outwardly and upwardly projecting foldlines **225*a*, 225*b* extend outwardly from the juncture of the slot 224 and the upper end of the center foldline 222**.

By reason of the arrangement of foldlines 221, 222 and 223, each opening X forms a common point for the apexes of six adjacent triangular panels $Y_1$–$Y_6$, the latter being symmetrically arranged about the opening, see FIG. 11. Panels $Y_1$ and $Y_4$ are of like configuration and are diametrically opposed to one another. The longer side of each panel $Y_1$ and $Y_4$ is formed by a foldline 222. The remaining sides of panels $Y_1$ and $Y_4$ are formed by portions of foldlines 221 and 223 disposed to one side of the common point X.

Foldline 222, which passes through the opening X, forms a common side of panels $Y_2$, $Y_3$ and of panels $Y_5$, $Y_6$ as well. It will be noted in FIG. 12 that, when the device 220 is in its operative mode, all of the common openings X protrude forwardly towards the interior surface $P_1$ of the windshield W whereas foldlines 222 are all recessed from such interior surface. When properly positioned relative to the windshield interior surface, device 220 presents an interesting esthetic appearance and yet, is highly effective in blocking the sun's rays and deflecting same in numerous directions thereby reducing the amount of reflecting of the sun's rays into the vehicle interior by the interior surface of the windshield. The foldline arrangement of the device 220 allows the latter to be more readily adjustable to the curvature of the windshield interior surface both in the vertical and horizontal axes.

As will be noted in FIGS. 13, 14, device 220, when in its collapsed inoperative mode, forms a compact relatively flat unit II, II' suitable for storage or shipping. In unit II, the triangular panels $Y_1$, $Y_2$ and $Y_6$, disposed to one side of the foldline 222 passing through the common point X, are arranged in a substantially coplanar relation and are folded together about foldlines 222 into face-to-face relation with panels $Y_3$, $Y_4$ and $Y_5$ located on the opposite side and previously arranged in coplanar relation. Thus, in unit II of device 220, the panels pivot about foldlines 222 as axes, thus resulting in unit II having a silhouette of substantially rectangular configuration.

In unit II of device 220, the panels $Y_1$ and $Y_4$ pivot about the corresponding portions of foldlines 221, 223 which define either $Y_2$, $Y_6$ or $Y_3$ $Y_5$ as the case may be. In addition, the panel $Y_1$ and adjacent panel $Y_4$, which are separated by a common foldline 222, not passing through an opening X, are foldable about said common foldline into face-to-face relation. As noted in FIG. 14, unit II' provides a unique and esthetic silhouette configuration. To maintain the panels of units II and II' of device 220 in a collapsed inoperative mode, a clip, tape, ribbon, rubber band or the like may be utilized in a manner, as shown in FIGS. 4 and 5.

It will be noted in all embodiments of the improved sunshielding device 20, 120 and 220 all of the adjoining foldably connected panels thereof have a multilateral (e.g., trapezoidal or triangular) configuration wherein none of the foldlines interconnecting a panel with adjoining panels are in spaced parallel relation. When any of the improved devices are in an operative mode, the shape of the panels and the arrangement of the foldlines connecting the panels allow the device to conform more readily to the curvature of the windshield interior surface, while at the same time providing a sun rays reflective surface which is effective as well as attractive in appearance. While the improved device has been described as being formed of double faced corrugated fibreboard, the invention is not intended to be limited thereto, as other types of material such as cardboard or plastic may be utilized which is relatively stiff, foldable, lightweight and inexpensive.

I claim:

1. A portable sunshielding device for positioning adjacent the interior surface of a windshield for a vehicle, said device being formed from a blank of foldable, relatively stiff, lightweight opaque sheet material, said blank having upper, lower and side edges and comprising a plurality of multilateral panels arranged in substantially side by side relation and spanning the distance between the blank upper and lower edges; adjoining panels being inteconnected by nonparallel foldlines, each extending substantially the distance between the blank upper and lower edges; said device being manually adjustable between operative and inoperative modes; when in an operative mode, said panels being angularly disposed relative to one another and being adapted to substantially overlie the windshield interior surface; when in an inoperative mode, predetermined panels being disposed in substantially face to face relation and forming a compact relatively flat unit, further comprising substantially parallel foldlines also spanning the distance between the blank upper and lower edges, each one of said parallel foldlines being located between two of said nonparallel foldlines, said nonparallel foldlines being angled so that predetermined pairs of said nonparallel foldlines intersect a respective parallel foldline therebetween at alternating upper and lower edges of said blank.

2. The sunshielding device of claim 1 wherein each of said panels has a substantially triangular configuration.

3. The sunshielding device of claim 1 wherein predetermined first parallel foldlines are disposed substantially perpendicular to the lower edge of the blank.

4. The sunshielding device of claim 1 wherein said parallel foldlines are disposed substantially perpendicular to the upper edge of the blank.

5. The sunshielding device of claim 1 wherein one of said foldlines is disposed substantially centrally of said blank and substantially perpendiucular to the lower edge of said blank, said one foldline having an upper end thereof terminating at the lower end of the slot extending endwise upwardly therefrom to the upper edge of the blank; said blank icluding a pair of diverging foldlinds extending from the slot lower end to the blank upper edge thereof.

* * * * *

UNITED STATES PATENT AND TRADEMARK OFFICE

CERTIFICATE OF CORRECTION

PATENT NO. : 4,777,994

DATED : Oct. 18, 1988

INVENTOR(S) : Terrill L. Nederveld

It is certified that error appears in the above-identified patent and that said Letters Patent is hereby corrected as shown below:

On the Title Page, Item [56], after References Cited, add --D294819 3/22/88 Kuri ..... D12/191--.

Column 2, line 16, "effectie" should be --effective--.

Column 3, line 59, "heeeinafter' should be --hereinafter--.

Column 3, line 63, "wil" should be --will--.

Column 8, line 33, "the" (second occurrence) should be --a--.

Column 8, line 36, "foldlinds" should be --foldlines--.

Signed and Sealed this

Twenty-seventh Day of June, 1989

*Attest:*

*Attesting Officer*

DONALD J. QUIGG

*Commissioner of Patents and Trademarks*